US006144311A

United States Patent [19]

Hahn et al.

[11] Patent Number: 6,144,311

[45] Date of Patent: Nov. 7, 2000

[54] TRAFFIC SIGNALLING APPARATUS FOR SELF-ILLUMINATING DISPLAYS

[75] Inventors: Ulrich Hahn, Wolfratshausen; Manfred Fillinger, Pulheim, both of Germany; Georg Meng, Eibikon, Switzerland; Stefan Beringer, Geretsried; Richard Wurzenberger, Munich, both of Germany

[73] Assignee: Siemens Aktiengesellschaft, Munich, Germany

[21] Appl. No.: 09/187,148

[22] Filed: Nov. 6, 1998

[30] Foreign Application Priority Data

Nov. 6, 1997 [DE] Germany ..... 197 49 129

[51] Int. Cl.[7] ..... G08B 5/22

[52] U.S. Cl. ..... 340/815.45; 340/815.49; 340/907; 315/187; 345/46; 345/82

[58] Field of Search ..... 340/815.45, 815.49, 340/908, 815.73, 907; 315/187; 345/44, 46, 48, 82

[56] References Cited

U.S. PATENT DOCUMENTS

| | | | |
|---|---|---|---|
| 3,560,967 | 2/1971 | Di Pilla | 340/815.49 |
| 3,887,803 | 6/1975 | Savage, Jr. | 340/815.45 |
| 3,918,053 | 11/1975 | Towne et al. | 340/815.45 |
| 4,729,076 | 3/1988 | Masami et al. | 362/235 |
| 4,851,832 | 7/1989 | Graf | 340/907 |
| 5,782,555 | 7/1998 | Hochstein | 362/373 |
| 5,785,418 | 7/1998 | Hochstein | 362/373 |
| 5,898,381 | 4/1999 | Garner et al. | 340/815.45 |
| 5,909,182 | 1/1999 | Van Alstine et al. | 340/815.52 |

FOREIGN PATENT DOCUMENTS

| | | |
|---|---|---|
| 0 467 034 A1 | 1/1992 | European Pat. Off. . |
| 0 694 894 A2 | 1/1996 | European Pat. Off. . |
| 2 551 242 | 3/1985 | France . |

OTHER PUBLICATIONS

Optoelektronische Anziegeelemente fur die Industrieelektronik, Wyer.

*Primary Examiner*—Edward Lefkowitz
*Assistant Examiner*—Davetta W. Goins
*Attorney, Agent, or Firm*—Hill & Simpson

[57] ABSTRACT

A traffic signalling apparatus wherein LEDs are employed to present various displays and the LEDs are secured with their sidewalls in a tubular holding device such that a good heat discharge from the LEDs to the holding device is guaranteed. The holding device is securely fixated in a front plate of the signalling apparatus, preferably detachably. An optical imaging device is additionally provided in order to achieve an emission characteristic which is optimized for traffic participants.

8 Claims, 2 Drawing Sheets

TRAFFIC SIGNALLING APPARATUS FOR SELF-ILLUMINATING DISPLAYS

BACKGROUND OF THE INVENTION

1. Field of the Invention

The present invention relates to a traffic signalling apparatus for self-illuminating displays wherein LEDs which are used to present various displays, are secured in a tubular holding device to ensure good heat discharge therethrough.

2. Description of the Prior Art

Incandescent lamps or halogen lamps are currently used for traffic signalling apparatuses with self-illuminating displays such as light signal apparatuses at intersections or alternating traffic signs. EP 0 467 034 teaches a display apparatus for an alternating traffic sign wherein arbitrary displays are presented which can be composed of, for example, at least one unalterable display part and one arbitrarily selectable display part. For each unalterable display part, separate illuminable bundles of light-conducting fibers are provided whose free ends are arranged in a display panel in distributed fashion corresponding to the allocated unalterable display part. The arbitrarily selectable display part can be displayed by means of a processor-controlled matrix field of display elements, wherein each display element is implemented by means of an illuminated light-conducting fiber. The illuminated light-conducting fibers are therein illuminated by halogen lamps. The short lifetime of halogen lamps on the one hand and their high energy consumption on the other are disadvantages of this method.

EP 0 694 894 teaches a signal lamp which is at least partially provided with light-emitting diodes which are mounted inside the signal lamp so as to be tiltable from a first emission direction to at least one second emission direction and which can be positioned by groups by means of adjusting disks. The holding device for such apparatus is, nevertheless, very complicated and not suitable for a simple assembly.

It is therefore an object of the present invention to propose a traffic signalling apparatus which includes a more robust construction and has a longer lifetime than the known signalling devices.

SUMMARY OF THE INVENTION

Such object is inventively achieved with a signalling apparatus of the abovementioned type wherein on the one hand, a good heat discharge is achieved by means of a holding device matched to the light-emitting diodes and, on the other hand, a simple assembly and a simple replacement of defective LEDs results on the basis of the fitted boreholes in the front plate of the signalling apparatus.

In an embodiment of the present invention, a particularly simple replacement or a particularly simple assembly results on the basis of a thread of the holding device which is fitted in a correspondingly preformed borehole of the front plate.

In an alternative embodiment of the present invention, a toothing at the holding device, which likewise guarantees a particularly simple assembly of the holding device, is employed.

In another embodiment of the present invention, a further improvement of the thermal conductivity of the holding device is achieved wherein the LED is secured in the holding device by a hardenable heat transfer compound.

In addition, a further embodiment of the present invention includes an improvement of the optical emission properties by means of an optical imaging means provided in the frontal opening of the holding device.

In another embodiment of the present invention, a particularly cost-effective development results from an optical imaging means made of a transparent plastic such as polymethacrylate (PMMA, trade name Plexiglass) or polycarbonate (PC, trade name Macrolon).

Also, in another embodiment of the present invention, particularly good thermal conductivity properties are exploited wherein the holding device and the front plate are produced from metallic materials.

In yet another embodiment of the present invention, only one terminal of the LED is contacted directly, and the other terminal (e.g. the ground terminal) is connected to the holding device in electrically conductive fashion, while the holding device is connected to the front plate in electrically conductive fashion, and the front plate is connected to the control device via a cable connection in electrically conductive fashion. The wiring outlay is thereby reduced.

Additional features and advantages of the present invention are described in, and will be apparent from, the Detailed Description of the Preferred Embodiments and the Drawings.

DETAILED DESCRIPTION OF THE PREFERRED EMBODIMENTS

Figure 1:
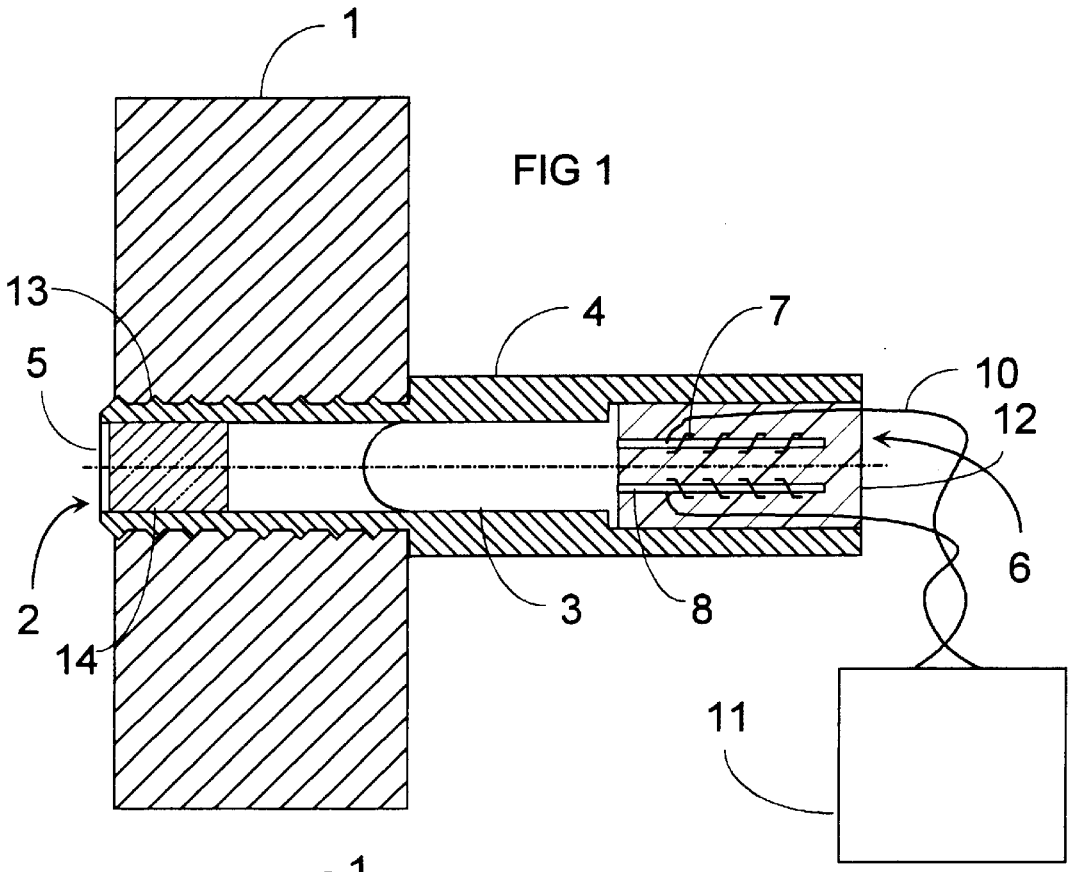
In FIG. 1, a schematic cross-section through a holding device with an optical imaging means is shown.

FIG. 1 depicts a section of a front plate 1 (e.g., consisting of aluminum) of a signalling apparatus such as an alternating traffic sign or a light signal device, wherein an LED 3 emits its light through a borehole 2 in the front plate 1. The LED 3 is therein secured in an inventive tubular holding device 4 such that a good contact for heat discharge is guaranteed between the sidewalls of the LED 3 and the holding device 4. The holding device 4 can be produced from a metallic material or from a plastic with good thermal conductivity properties, for example. The LED 3 is therein secured in the holding device 4 such that the light emitted by the LED 3 is emitted through the front plate 1 through a first opening (light exit aperture 5) of the holding device 4, and the LED 3 is contacted through a second opening of the holding device 4 (contacting aperture 6). The cathode terminal 7 and the anode terminal 8 of the LED 3 are therein connected to the control device 11 via cable connections 10; this control device switching the LED 3 on and off according to the display to be described. The anode terminal 8 and the cathode terminal 7 are jointly securely connected to the cable connections 10 with the aid of a hardenable heat transfer compound 12, wherein the heat transfer compound 12 guarantees not only a good heat discharge but also a secure fixation of the LED 3 in the holding device 4. In the direction of the light exit aperture 5, the holding means 4 is provided with a thread 13 on the outside which is inserted in a corresponding thread in the borehole 2 of the front plate 1. A connection which can be assembled particularly favorably and potentially detached is thereby achieved between the front plate 1 and the holding device 4. For improvement of the emission characteristic, an optical imaging means 14 is provided in the holding means 4 with the aid of which the emission characteristic is adapted to the local conditions, so that the display is recognized well by all traffic participants. The optical imaging means 14 is therein produced from glass or from a cost-effective transparent plastic such as Polymethacrylate (PMMA, trade name plexiglass) or Polycarbonate (PC, trade name Macrolon).

Figure 2:
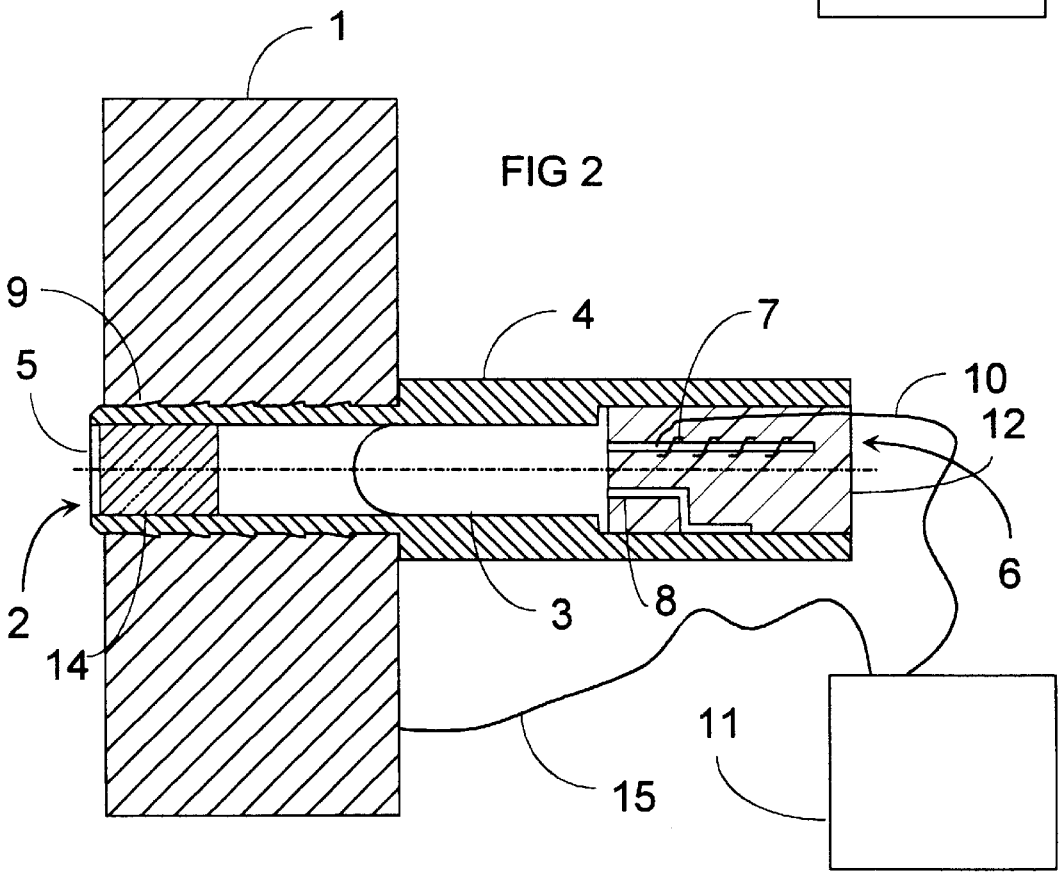
In FIG. 2, a schematic cross-section through a holding device is shown, wherein a terminal of the LED with the holding device is contacted.

FIG. 2 depicts another embodiment wherein the anode terminal 8 includes a conductive connection with the holding device 4, which is produced from metallic material in this example. A particularly simple contacting of the LED 3 can be achieved by means of a conductive connection between the holding device 4 and the front plate, which likewise consists of a metallic material, in that a cable connection 15 is laid out from the control device 11 to the front plate 1. The cabling outlay thus can be reduced by a factor of two. One terminal (e.g. the ground terminal) of all the LEDs 3 provided in the signalling apparatuses is thus jointly connected to the control device 11 via the front plate 1 and the holding device 4. The holding device 4 includes a toothing 9 which guarantees a particularly simple assembly with the front plate.

Figure 3:
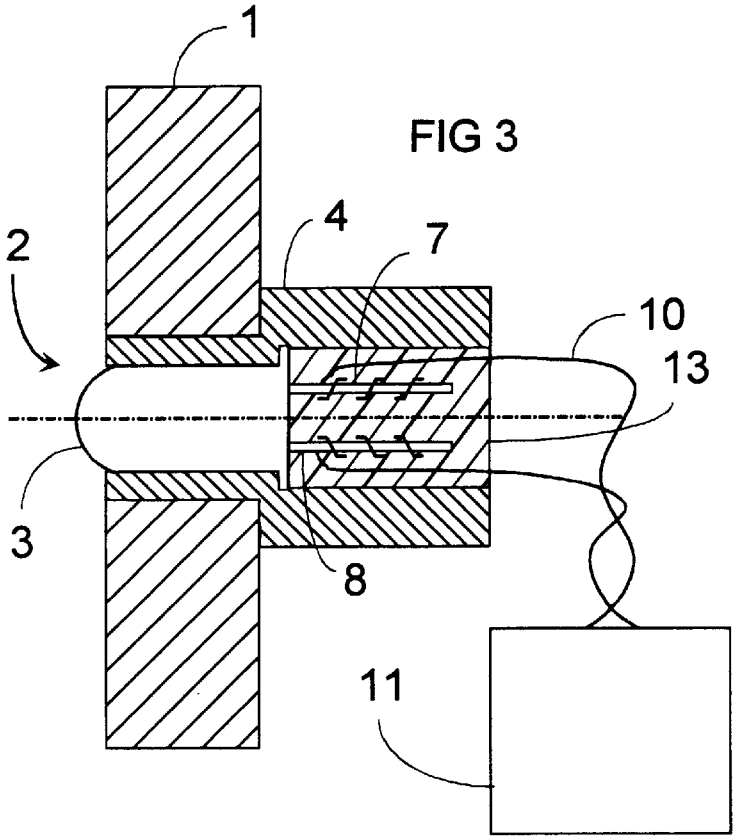
In FIG. 3, a schematic cross-section through a holding device without optical imaging means is shown.

FIG. 3 schematically and simply depicts how a holding device 4 without optical imaging means is arranged.

Figure 4:
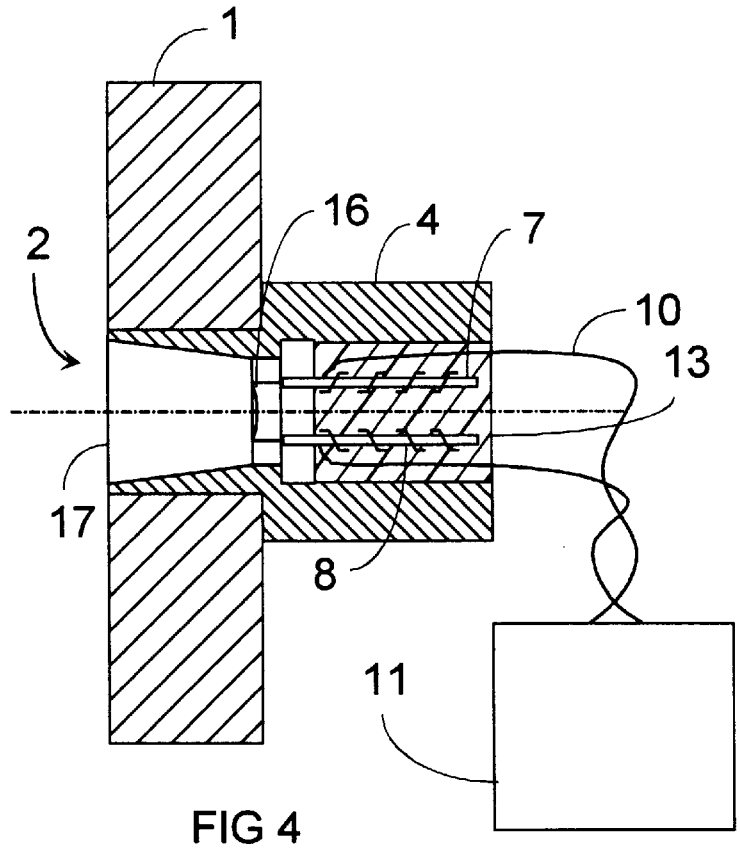
In FIG. 4, a schematic cross-section through a holding device for an LED attached on a chip with correspondingly adapted optical imaging means is shown.

FIG. 4 depicts an embodiment wherein, instead of the LED 3, an LED 16 is arranged on a semiconductor chip in a holding device 4. An optical imaging means 17 specifically adapted to the LED 16 on the semiconductor chip is therein provided in the light exit aperture 5 of the holding device 4. As in the preceding embodiments, the contacting ensues via the cathode terminal 7 and the anode terminal 8 and cable connections 10 to the control device 11. It is also possible in this embodiment to implement one terminal connection by means of an electrical contact to the front plate 1 via the holding device 4 in order to achieve a reduced number of cable connections.

Although the present invention has been described with reference to specific embodiments, those of skill in the art will recognize that changes may be made thereto without departing from the spirit and scope of the invention as set forth in the hereafter appended claims.

We claim as our invention:

1. A traffic signalling apparatus for self-illuminating displays, comprising:

a plurality of LEDs from which the self-illuminating displays are at least partially composed;

a front plate on a front of the apparatus, the front plate including a plurality of boreholes;

a plurality of separate tubular holding devices formed of a material have a thermal conductivity which is on an order of magnitude of a thermal conductivity of a metal, each holding device respectively secured in one of the plurality of boreholes, each holding device further having one of the LEDs respectively arranged and fixed therein wherein lateral surfaces of the respective LED are surrounded by the holding device such that light emitted by each LED exits through a first aperture of the holding device and the LED is electrically connected through a second aperture of the holding device; and a control device which actuates the LEDs and to which the LEDs are electrically connected.

2. A traffic signalling apparatus as claimed in claim 1, wherein the holding devices and the front plate are connected to each other by a thread.

3. A traffic signalling apparatus as claimed in claim 1, wherein the holding devices include a toothing for connection to the front plate.

4. A traffic signalling apparatus as claimed in claim 1, wherein each LED is connected to a respective holding device in the region of the contacting aperture by means of a hardenable heat transfer compound.

5. A traffic signalling apparatus as claimed in claim 1, further comprising:

an optical imaging means arranged in the light exit aperture.

6. A traffic signalling apparatus as claimed in claim 5, wherein the optical imaging means is produced from a transparent plastic.

7. A traffic signalling apparatus as claimed in claim 1, wherein the holding device and the front plate are produced from metallic material.

8. A traffic signalling apparatus as claimed in claim 7, wherein an electrical terminal of each LED is electrically connected to the holding device, the holding device is electrically connected to the front plate, and the front plate is electrically connected to the control device.

* * * * *